US009708676B2

(12) United States Patent
Tang et al.

(10) Patent No.: US 9,708,676 B2
(45) Date of Patent: Jul. 18, 2017

(54) METHOD FOR PREPARING LOW-COST CLEAN STEEL

(76) Inventors: Fuping Tang, Anshan (CN); Zhen Li, Anshan (CN); Xiaofeng Wang, Anshan (CN); Peng Fei, Anshan (CN); Jinsong Meng, Anshan (CN); Yue Zhang, Anshan (CN); Yong Ma, Anshan (CN); Wenzhong Wang, Anshan (CN); Zhiwen Zhang, Anshan (CN); Xiaoshan Wang, Anshan (CN); Meng Guo, Anshan (CN); Zhigang Zhao, Anshan (CN); Yang Lin, Anshan (CN); Guoqiang Xin, Anshan (CN); Weizhi Yao, Anshan (CN)

( * ) Notice: Subject to any disclaimer, the term of this patent is extended or adjusted under 35 U.S.C. 154(b) by 389 days.

(21) Appl. No.: 14/384,981

(22) PCT Filed: Mar. 13, 2012

(86) PCT No.: PCT/CN2012/000311

§ 371 (c)(1),
(2), (4) Date: Sep. 12, 2014

(87) PCT Pub. No.: WO2013/134889

PCT Pub. Date: Sep. 19, 2013

(65) Prior Publication Data

US 2015/0027656 A1 Jan. 29, 2015

(51) Int. Cl.

| | |
|---|---|
| ***C21C 1/02*** | (2006.01) |
| ***C21C 7/06*** | (2006.01) |
| ***C21C 7/064*** | (2006.01) |
| ***C21C 7/00*** | (2006.01) |
| ***C21C 7/10*** | (2006.01) |
| ***B22D 11/00*** | (2006.01) |
| ***C21C 5/35*** | (2006.01) |
| ***C21C 5/36*** | (2006.01) |
| *C21C 7/072* | (2006.01) |

(52) U.S. Cl.

CPC ..... *C21C 7/064* (2013.01); *B22D 11/001* (2013.01); *C21C 1/025* (2013.01); *C21C 5/35* (2013.01); *C21C 5/36* (2013.01); *C21C 7/0043* (2013.01); *C21C 7/0087* (2013.01); *C21C 7/0645* (2013.01); *C21C 7/10* (2013.01); *C21C 7/0068* (2013.01); *C21C 7/072* (2013.01); *C21C 2300/08* (2013.01)

(58) Field of Classification Search

CPC .. C21C 1/00; C21C 1/02; C21C 1/025; C21C 7/04; C21C 7/06; C21C 7/064; C21C 7/0645

See application file for complete search history.

(56) References Cited

U.S. PATENT DOCUMENTS

| | | | | |
|---|---|---|---|---|
| 4,726,839 A * | 2/1988 | Berger | C21O 5/5211 | 75/10.1 |
| 5,397,379 A * | 3/1995 | Barker | C21C 7/0075 | 75/303 |
| 2003/0177864 A1* | 9/2003 | Nakai | C21C 1/02 | 75/313 |
| 2005/0257644 A1* | 11/2005 | Nakai | C21B 3/04 | 75/315 |

FOREIGN PATENT DOCUMENTS

| | | |
|---|---|---|
| CN | 101323893 | * 12/2008 |
| CN | 101956040 | * 1/2012 |

OTHER PUBLICATIONS

Peng, Investigation on the novel technology of the fine inclusion removal due to the dispersed in-situ phase induced by the composite ball explosive reaction. Advanced Materials Research Online: Jul. 4, 2011 ISSN: 1662-8985, vols. 287-290, pp. 1991-1996.*

* cited by examiner

*Primary Examiner* — Matthew E Hoban

(57) ABSTRACT

A method for preparing low-cost clean steel includes steps of: preliminarily desulfurizing iron melt: preliminarily desulfurizing in an iron melt channel during blast furnace tapping and during iron folding in an iron folding room, adding a desulfurizing ball into the iron melt during the blast furnace tapping or the iron folding; dephosphorizing and controlling sulfur: dephosphorizing and controlling sulfur during converter steelmaking, in such a manner that P≤0.014% and S≤0.004% during tapping; rapidly dephosphorizing by slag-forming: rapidly dephosphorizing by slag-forming during converter tapping, at a converter end point, controlling a C content at 0.02~0.10%, adding a dephosphorizing ball through an alloy chute during the converter tapping, blowing argon and stirring at the same time; purifying steel melt during RH refining: adding a purifying ball at a late stage of the RH refining when a vacuum degree is at 66.7~500 Pa; and continuously casting with whole-process protection.

4 Claims, No Drawings

METHOD FOR PREPARING LOW-COST CLEAN STEEL

CROSS REFERENCE OF RELATED APPLICATION

This is a U.S. National Stage under 35 U.S.C 371 of the International Application PCT/CN2012/000311, filed Mar. 13, 2012.

BACKGROUND OF THE PRESENT INVENTION

Field of Invention

The present invention relates to a steel production technology, and more particularly to a method for preparing low-cost clean steel, which belongs to a field of metallurgical technology Description of Related Arts Cleanliness is an important sign reflecting overall quality of steel. The cleanliness is usually judged from content of harmful elements in the steel, and number, shape as well as size of non-metallic inclusions. "Clean and pure" steel is typically obtained by reducing and controlling residual elements such as P, S, N, H, T.O, C, Al, and Ti in the steel. The elements affect steel performance in a single or combined form. In order to improve the intrinsic quality and performance of the steel, basic requirements for iron and steel metallurgy technology development are: (1) maximizing removal of harmful elements such as S, P, N, H, and T.O (wherein sometimes C is comprised) in steel; (2) precisely controlling element contents in steel; (3) strictly controlling inclusion quantity, composition, morphology, size and distribution, and converting the inclusion to harmless or even beneficial elements; and (4) casting without defect. With development and application of clean steel metallurgy technology, requirements for ferroalloy and auxiliary materials for steelmaking are stricter. For example, in order to meet the increasing toughness requirements for pipeline steel, especially the increasing requirement for HIC-resistance performance of acidic gas pipeline, the content of S in the steel keeps decreasing. For auto sheet (or car shell), C, N, and T.O should be less than 20 ppm. Diameter of inclusion in tire radial should be less than 10 μm. In order to improve the anti-contact fatigue performance, T.O in ball bearing steel should be less than 10 ppm, or even lower. With the rapid development of steel metallurgy technology for improving the cleanliness, T.O+N+P+S+H in the steel has been equal to or less than 80 ppm during production. CN1480549, published Mar. 10, 2004, discloses a barium-contained clean steel and a production method thereof, which relates to a field of alloy steel, and particularly to barium-contained alloy steel. The production method of the barium-contained clean steel comprises steps of: after melted in a conventional electric furnace, converter, or other vacuum melting furnace, refining in a refining apparatus, and barium-alloying at a late stage of refining; before adding a barium alloying element, adding aluminum deoxidizer or silica-aluminum for pre-deoxidizing, then blowing argon, and adding barium alloy for producing the barium-contained clean steel. However, the cleanliness of the final product is not sufficient, and the published element percentages by weight in the clean steel are: Ba 0.0001~0.04%, S≤0.035%, P≤0.035%, A, B, C and D type inclusions are generally of 1.0~0.5 degree, which do not meet the requirements of a higher cleanliness.

In addition, clean steel standard is not only a technical problem. First of all, it is an economic problem. For producers to improve the cleanliness of steel with their own equipments and technology, unless the required cleanliness is too high, the cleanliness object is usually able to be achieved. As a result, the production cost is bound to increase, and the user has to pay for the desired high cleanliness.

SUMMARY OF THE PRESENT INVENTION

For overcoming disadvantages of conventional clean steel production, an object of the present invention is to provide a high-quality steel material with S at 5~20 ppm, P at 20~60 ppm, an overall oxygen content at 3~15 ppm, and an inclusion equivalent diameter at 0.5~10 μm, and to provide a method for preparing low-cost clean steel by which a cost is effectively lowered.

Accordingly, in order to accomplish the above object, the present invention provides a method for preparing low-cost clean steel, comprising steps of:

a) preliminarily desulfurizing iron melt: preliminarily desulfurizing in an iron melt channel during blast furnace tapping and during iron folding in an iron folding room, adding a desulfurizing ball into the iron melt during the blast furnace tapping or the iron folding, in such a manner that S≤0.01% by weight in the iron melt after preliminarily desulfurizing;

b) pre-desulfurizing the iron melt: finely desulfurizing the iron melt by dusting desulfurization, and filtering out desulfurized slags by a slag filter, in such a manner that after finely desulfurizing, S≤0.0015% by weight in the iron melt before being sent into a converter;

c) dephosphorizing and controlling sulfur: dephosphorizing and controlling sulfur during converter steelmaking, in such a manner that P≤0.014% and S≤0.004% during tapping;

d) rapidly dephosphorizing by slag-forming: rapidly dephosphorizing by slag-forming during converter tapping; at a converter end point, controlling a C content at 0.02~0.10%, controlling an oxygen activity value $\alpha_O$ at 600~1000 ppm, adding a dephosphorizing ball through an alloy chute during the converter tapping, blowing argon and stirring at the same time;

e) purifying steel melt during RH refining: adding a purifying ball at a late stage of the RH refining when a vacuum degree is at 66.7~500 Pa; and f) continuously casting with whole-process protection;

wherein the desulfurizing ball comprises: white slags cool-collected by a ladle furnace 20~55%, CaO 20~50%, $CaF_2$ 5~15%, and $CaCO_3$ 5~15% by weight, wherein particle sizes of the CaO, $CaF_2$, $CaCO_3$ and the white slags cool-collected by the ladle furnace are less than 100 μm;

wherein the dephosphorizing ball comprises: white slags cool-collected by a ladle furnace 10~65%, CaO 10~65%, $CaF_2$ 1~15%, and $CaCO_3$ 5~30% by weight, particle sizes of the CaO, $CaF_2$, $CaCO_3$ and the white slags cool-collected by the ladle furnace are less than 100 μm; and wherein the purifying ball comprises: white slags cool-collected by a ladle furnace 10~60%, CaO 15~65%, $CaF_2$ 1~15%, $CaCO_3$ 5~30%, and Ca powder 1~15% by weight, particle sizes of the CaO, $CaF_2$, $CaCO_3$ and the white slags cool-collected by the ladle furnace are less than 100 μm.

Preferably, in the step a), an amount of the desulfurizing ball is 2~8 kg/t.

Preferably, in the step d), an amount of the dephosphorizing ball is 3~12 kg/t, blowing strength of the argon is 30 $Nm^3 \cdot t^{-1} \cdot h$~150 $Nm^3 \cdot t^{-1} \cdot h$, and a blowing and stirring time of the argon is 0~7 min.

Preferably, in the step e), when adding the purifying ball, a downing tube is at an opposite side of a feeding opening.

Preferably, the desulfurizing ball, the dephosphorizing ball and the purifying ball are all produced by dry-pressing, sizes thereof are 5~25 mm, compression strength thereof is 5~35 MPa, and a reaction time of delay burst at 1600° C. is 1~35 s.

Preferably, the CaO in the purifying ball comprises MgO and CaO with any mixing ratio.

Preferably, the $CaCO_3$ in the purifying ball comprises $MgCO_3$ and $CaCO_3$ with any mixing ratio, and a particle size of the $MgCO_3$ is less than 100 μm.

Preferably, the Ca powder in the purifying ball comprises Mg powder and Ca powder with any mixing ratio, and particle sizes of the Mg powder and the Ca powder are less than 1 mm.

Preferably, MgO activity ≥200 ml, and CaO activity ≥200 ml.

The conventional charging methods of iron and steel metallurgy are directly adding block material or blowing powder. If the block material is added, a melting time is long, energy consumption is large, and uneven composition is easy to be caused. If the powder is blown, during charging materials, blowing loss is large, and cost of steelmaking is high. The present invention provides a new charging method, namely reaction-induced micro heterogeneous, which means adding block material into steel melt and then forming powder in the steel melt by burst reaction.

According to the present invention, balls with the above functions are designed. The ball will decompose at a high temperature, and release micro bubbles as well as slag drops. By adding small particles of sodium carbonate into the steel melt, the micro bubbles will be generated in the steel melt. The micro bubbles are able to uniformize composition and temperature of the steel melt, and the inclusions are directly removed with capture and adsorption effects of the micro bubbles. According to the present invention, $CaCO_3$, $MgCO_3$, or ($CaCO_3$+$MgCO_3$) composite powder is utilized as a situ agent for generating the micro bubbles. High-temperature decomposition of the $CaCO_3$ and the $MgCO_3$ are as follows:

$$CaCO_3 \xrightarrow{825^\circ C.} CO_2 \uparrow + CaO \quad (1)$$

$$MgCO_3 \xrightarrow{825^\circ C.} CO_2 \uparrow + MgO \quad (2)$$

According to researches, when carbonate powder is small enough, a size of a bubble generated is about a size of the powder. Therefore, the method is able to add ultra-fine bubbles into the steel melt (wherein the size of the bubble is between 100~300 μm). The smaller the bubbles are, the higher inclusion removal efficiency will be. In addition, alkaline earth oxides, another product of the decomposition reaction of carbonate, will be rapidly melted in the steel melt for forming the slag drops with a slag washing effect. Because of low reaction temperature of decomposition of the carbonates and poor thermal stability thereof, the disadvantage must be eliminated by reasonable designs. According to the present invention, the CaO, MgO, (CaO+MgO) composite powder or the white slags cool-collected by the ladle furnace is utilized as a carrier of the carbonate powder. By combining the carrier and the carbonate powder into the ball with a certain size, the thermal stability of the carbonate in the steel melt is improved.

Advantages of the present invention are as follows. Process is simple, and operation is convenient. Different balls are respectively added during the blast furnace tapping, the iron folding in the iron folding room, the converter tapping, and the late stage of the RH refining, so as to rapidly desulfurize, dephosphorize, and remove the small inclusions in the steel melt by slag-forming. Furthermore, the P and S contents in the steel are significantly reduced, while quantity and size distribution of small non-metallic inclusions remaining in the steel during refining is effectively controlled. With the method according to the present invention, S in the steel is controlled at 5~20 ppm, P is controlled at 20~60 ppm, the overall oxygen content is controlled at 3~15 ppm, and the inclusion equivalent diameter is controlled at 0.5~10 μm. Compared with the conventional process, raw materials utilized in the method are cheap, the cost for the steel per ton is reduced by 0.8~1.6 USD.

DETAILED DESCRIPTION OF THE PREFERRED EMBODIMENT

These and other objectives, features, and advantages of the present invention will become apparent from the following detailed description, the accompanying drawings, and the appended claims. One skilled in the art will understand that the embodiment of the present invention as shown in the drawings and described above is exemplary only and not intended to be limiting. It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

Preferred Embodiment 1 a method for preparing low-cost clean steel by which a cost is effectively lowered.

Accordingly, in order to accomplish the above object, the present invention provides a method for preparing low-cost clean steel, comprising steps of:

a) preliminarily desulfurizing iron melt: preliminarily desulfurizing in an iron melt channel during blast furnace tapping and during iron folding in an iron folding room, adding a desulfurizing ball into the iron melt during the blast furnace tapping or the iron folding, wherein an amount of the desulfurizing ball is 2~8 kg/t, in such a manner that S≥0.01% by weight in the iron melt after preliminarily desulfurizing;

b) pre-desulfurizing the iron melt: finely desulfurizing the iron melt by dusting desulfurization with mixed powder of CaO and Mg powder, and filtering out desulfurized slags by a slag filter, in such a manner that after finely desulfurizing, S≤0.0015% by weight in the iron melt before being sent into a converter;

c) dephosphorizing and controlling sulfur: dephosphorizing and controlling sulfur during converter steelmaking, in such a manner that P≤0.014% and S≤0.004% during tapping;

d) rapidly dephosphorizing by slag-forming: rapidly dephosphorizing by slag-forming during converter tapping;

at a converter end point, controlling a C content at 0.02~0.10%, controlling an oxygen activity value $\alpha_O$ at 600~1000 ppm, adding a dephosphorizing ball through an alloy chute during the converter tapping, blowing argon and stirring at the same time, wherein an amount of the dephosphorizing ball is 3~12 kg/t, blowing strength of the argon is 30 $Nm^3 \cdot t^{-1}$~h~150 $Nm^3 \cdot t^{-1} \cdot h$, a blowing and stirring time of the argon is 0~7 min;

e) purifying steel melt during RH refining: adding a purifying ball at a late stage of the RH refining when a vacuum degree is at 66.7~500 Pa, wherein when adding the purifying ball, a downing tube is at an opposite side of a feeding opening; and f) continuously casting with whole-process protection.

The desulfurizing ball comprises: slags obtained during ladle furnace refining, namely white slags cool-collected by a ladle furnace, 20 kg; CaO 50 kg; $CaF_2$ 15 kg; and $CaCO_3$ 15 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 65 kg; CaO 10 kg; $CaF_2$ 1 kg; and $CaCO_3$ 5 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 10 kg; CaO 65 kg; $CaF_2$ 15 kg; $CaCO_3$ 30 kg; and Ca powder 15 kg; particle sizes of the CaO, $CaF_2$, $CaCO_3$ and the white slags cool-collected by the ladle furnace are less than 100 μm, and a particle size of the Ca powder is less than 1 mm.

MgO activity ≥200 ml, and CaO activity ≥200 ml.

Preferred Embodiment 2

The desulfurizing ball comprises: slags obtained during ladle furnace refining, namely white slags cool-collected by a ladle furnace, 55 kg; CaO 20 kg; $CaF_2$ 5 kg; and $CaCO_3$ 5 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 10 kg; CaO 65 kg; $CaF_2$ 15 kg; and $CaCO_3$ 30 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 60 kg; MgO 15 kg; $CaF_2$ 1 kg; $MgCO_3$ 5 kg; and Mg powder 1 kg; particle sizes of the $CaF_2$, $MgCO_3$ and the white slags cool-collected by the ladle furnace are less than 100 μm, and a particle size of the Mg powder is less than 1 mm. Other features of the preferred embodiment 2 are the same as the features of the preferred embodiment 1, and will not be illustrated again.

Preferred Embodiment 3

The desulfurizing ball comprises: slags obtained during ladle furnace refining, namely white slags cool-collected by a ladle furnace, 35 kg; CaO 35 kg; $CaF_2$ 10 kg; and $CaCO_3$ 10 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 38 kg; CaO 38 kg; $CaF_2$ 10 kg; and $CaCO_3$ 12 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 35 kg; mixed powder of CaO and MgO with any mixing ratio 40 kg; $CaF_2$ 7 kg; mixed powder of $CaCO_3$ and $MgCO_3$ with any mixing ratio 15 kg; and Ca powder 1 kg; particle sizes of the CaO, $CaF_2$, $CaCO_3$, $MgCO_3$ and the white slags cool-collected by the ladle furnace are less than 100 μm, and a particle size of the Ca powder is less than 1 mm. Other features of the preferred embodiment 3 are the same as the features of the preferred embodiment 1, and will not be illustrated again.

Preferred Embodiment 4

The desulfurizing ball comprises: slags obtained during ladle furnace refining, namely white slags cool-collected by a ladle furnace, 45 kg; CaO 40 kg; $CaF_2$ 13 kg; and $CaCO_3$ 12 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 41 kg; CaO 45 kg; $CaF_2$ 5 kg; and $CaCO_3$ 20 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 20 kg; mixed powder of CaO and MgO with any mixing ratio 55 kg; $CaF_2$ 3 kg; $CaCO_3$ 20 kg; and Ca powder 12 kg; particle sizes of the CaO, $CaF_2$, $CaCO_3$ and the white slags cool-collected by the ladle furnace are less than 100 μm, and a particle size of the Ca powder is less than 1 mm. Other features of the preferred embodiment 4 are the same as the features of the preferred embodiment 1, and will not be illustrated again.

Preferred Embodiment 5

The desulfurizing ball comprises: slags obtained during ladle furnace refining, namely white slags cool-collected by a ladle furnace, 25 kg; CaO 30 kg; $CaF_2$ 8 kg; and $CaCO_3$ 14 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 20 kg; CaO 55 kg; $CaF_2$ 12 kg; and $CaCO_3$ 10 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 40 kg; MgO 30 kg; $CaF_2$ 11 kg; mixed powder of $CaCO_3$ and $MgCO_3$ with any mixing ratio 25 kg; and mixed powder of Ca powder and Mg powder with any mixing ratio 13 kg; particle sizes of the $CaF_2$, $CaCO_3$, $MgCO_3$ and the white slags cool-collected by the ladle furnace are less than 100 μm, and particle sizes of the Ca powder and Mg powder are less than 1 mm. Other features of the preferred embodiment 5 are the same as the features of the preferred embodiment 1, and will not be illustrated again.

Preferred Embodiment 6

The desulfurizing ball comprises: slags obtained during ladle furnace refining, namely white slags cool-collected by a ladle furnace, 30 kg; CaO 45 kg; $CaF_2$ 6 kg; and $CaCO_3$ 9 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 50 kg; CaO 25 kg; $CaF_2$ 8 kg; and $CaCO_3$ 22 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 50 kg; CaO 20 kg; $CaF_2$ 4 kg; $MgCO_3$ 10 kg; and Ca powder 5 kg; particle sizes of the CaO, $CaF_2$, $MgCO_3$ and the white slags cool-collected by the ladle furnace are less than 100 m, and a particle size of the Ca powder is less than 1 mm. Other features of the preferred embodiment 6 are the same as the features of the preferred embodiment 1, and will not be illustrated again.

Preferred Embodiment 7

The desulfurizing ball comprises: slags obtained during ladle furnace refining, namely white slags cool-collected by a ladle furnace, 50 kg; CaO 48 kg; $CaF_2$ 7 kg; and $CaCO_3$ 9 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 45 kg; CaO 25 kg; $CaF_2$ 3 kg; and $CaCO_3$ 8 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 45 kg; CaO 25 kg; $CaF_2$ 5 kg; $MgCO_3$ 15 kg; and Mg powder 4 kg; particle sizes of the CaO, $CaF_2$, $MgCO_3$ and the white slags cool-collected by the ladle furnace are less than 100 μm, and a particle size of the Mg powder is less than 1 mm. Other features of the preferred embodiment 7 are the same as the features of the preferred embodiment 1, and will not be illustrated again.

Preferred Embodiment 8

The desulfurizing ball comprises: slags obtained during ladle furnace refining, namely white slags cool-collected by a ladle furnace, 45 kg; CaO 25 kg; $CaF_2$ 12 kg; and $CaCO_3$ 7 kg; particle sizes of the CaO, $CaF_2$, $CaCO_3$ and the white slags cool-collected by the ladle furnace are less than 100 μm, the desulfurizing ball is produced by dry-pressing, a size thereof is 5~25 mm, compression strength thereof is 5~35 MPa, and a reaction time of delay burst at 1600° C. is 1~35 s;

The dephosphorizing ball comprises: slags obtained during ladle furnace refining, namely white slags cool-collected by a ladle furnace, 28 kg; CaO 35 kg; $CaF_2$ 13 kg; and $CaCO_3$ 18 kg; particle sizes of the CaO, $CaF_2$, $CaCO_3$ and the white slags cool-collected by the ladle furnace are less than 100 μm, the dephosphorizing ball is produced by dry-pressing, a size thereof is 5~25 mm, compression strength thereof is 5~35 MPa, and a reaction time of delay burst at 1600° C. is 1~35 s;

The purifying ball comprises: slags obtained during ladle furnace refining, namely white slags cool-collected by a ladle furnace, 25 kg; mixed powder of CaO and MgO with any mixing ratio 35 kg; $CaF_2$ 13 kg; $CaCO_3$ 7 kg; and mixed powder of Ca powder and Mg powder with any mixing ratio 11 kg; particle sizes of the CaO, $CaF_2$, $CaCO_3$ and the white slags cool-collected by the ladle furnace are less than 100 μm, and particle sizes of the Ca powder and Mg powder are less than 1 mm. Other features of the preferred embodiment 8 are the same as the features of the preferred embodiment 1, and will not be illustrated again.

Comparison

A conventional method for preparing clean steel comprises steps of:

a) pre-desulfurizing the iron melt: finely desulfurizing the iron melt by dusting desulfurization with mixed powder of CaO and Mg powder, and filtering out desulfurized slags by a slag filter, in such a manner that $S \leq 0.0020\%$ by weight in the iron melt after finely desulfurizing;

b) dephosphorizing and controlling sulfur: dephosphorizing and controlling sulfur during converter steelmaking, in such a manner that P≤0.014% and S≤0.004% during tapping;

c) purifying steel melt during RH refining; and d) continuously casting with whole-process protection.

By sampling at a ¼ position of an inner arc of a casting bank, analyzing sharps and particle sizes of inclusions with a 500× microscope, analyzing an inclusion area content (within an area of 10×10 mm) by quantitative metallography, and analyzing a total oxygen content by a nitrogen and oxygen analyzer, total oxygen, inclusion, P and S contents were detected by chemical analysis and are illustrated in Table 1.

According to the preferred embodiments and comparison in the Table 1, test data of S and P control, total oxygen control, and inclusion control in the steel illustrate that the method according to the present invention is superior to the method in the comparison in both single control and overall control. Furthermore, for the high-quality steel provided by the present invention, S in the steel is controlled at 5~20 ppm, P is controlled at 20~60 ppm, the overall oxygen content is controlled at 3~15 ppm, and the inclusion equivalent diameter is controlled at 0.5~10 μm.

TABLE 1

| Embodiment | Total oxygen (ppm) | Max inclusion size (μm) | Average inclusion area content (%) | P (ppm) | S (ppm) |
|---|---|---|---|---|---|
| Preferred embodiment 1 | 14 | 8.34 | 0.00803 | 30 | 20 |
| Preferred embodiment 2 | 10 | 7.1 | 0.005 | 20 | 20 |
| Preferred embodiment 3 | 8 | 6.2 | 0.004 | 50 | 10 |
| Preferred embodiment 4 | 6 | 5.2 | 0.003 | 40 | 10 |
| Preferred embodiment 5 | 6 | 6.8 | 0.0035 | 50 | 6 |
| Preferred embodiment 6 | 4 | 4 | 0.0015 | 30 | 5 |
| Preferred embodiment 7 | 15 | 9.5 | 0.0091 | 50 | 20 |
| Preferred embodiment 8 | 10 | 8.8 | 0.0085 | 40 | 20 |
| Comparison | 26 | 39.7 | 0.01239 | 100 | 50 |

What is claimed is:

1. A method for preparing low-cost clean steel, comprising steps of:

a) preliminarily desulfurizing iron melt: preliminarily desulfurizing in an iron melt channel during blast furnace tapping by adding a desulfurizing ball into the iron melt during the blast furnace tapping, in such a manner that after preliminarily desulfurizing, S≤0.01% by weight in the iron melt before being sent into a converter;

b) finely desulfurizing the iron melt: after the step a) finely desulfurizing the iron melt by filtering out desulfurized slags by a slag filter, in such a manner that S≤0.0015% by weight in the iron melt after finely desulfurizing;

c) dephosphorizing and controlling sulfur: after the step b) dephosphorizing and controlling sulfur during converter steelmaking, in such a manner that P≤0.014% and S≤0.004% during converter tapping;

d) rapidly dephosphorizing by slag-forming: after the step c) rapidly dephosphorizing by slag-forming during the converter tapping; at a converter end point, controlling a C content in iron at 0.02~0.10%, controlling an oxygen activity value $\alpha_O$ in the iron at 600~1000 ppm, adding a dephosphorizing ball through an alloy chute during the converter tapping, blowing argon and stirring at the same time;

e) purifying steel melt during RH refining: after the step d), RH refining the iron obtained in the step d), and adding a purifying ball at a late stage of the RH refining when a vacuum degree is at 66.7~500 Pa; and f) after the step e), continuously casting the iron obtained in the step e) with whole-process protection;

wherein the desulfurizing balls comprises: white slags cool-collected by a ladle furnace from 20~55% by weight, CaO from 20~50% by weight, $CaF_2$ from 5~15% by weight, and $CaCO_3$ from 5~15% by weight, wherein particle sizes of the CaO, $CaF_2$, $CaCO_3$ and the white slags cool-collected by the ladle furnace are less than 100 μm;

wherein the dephosphorizing ball comprises: white slags cool-collected by a ladle furnace from 10~65% by weight, CaO from 10~65% by weight, $CaF_2$ from 1~15% by weight, and $CaCO_3$ from 5~30% by weight, particle sizes of the CaO, $CaF_2$, $CaCO_3$ and the white slags cool-collected by the ladle furnace are less than 100 μm; and wherein the purifying ball comprises: white slags cool-collected by a ladle furnace from 10~60% by weight, CaO from 15~65% by weight, $CaF_2$ from 1~15% by weight, $CaCO_3$ from 5~30% by weight, and Ca powder from 1~15% by weight, particle sizes of the CaO, $CaF_2$, $CaCO_3$ and the white slags cool-collected by the ladle furnace are less than 100 μm.

2. The method, as recited in claim 1, wherein in the step a), an amount of the desulfurizing ball is 2~8 kg/t.

3. The method, as recited in claim 1, wherein in the step d), an amount of the dephosphorizing ball is 3~12 kg/t, blowing strength of the argon is 30 $Nm^3 \cdot t^{-1} \cdot h$~150 $Nm^3 \cdot t^{-1} \cdot h$, a blowing and stirring time of the argon is 0~7 min.

4. The method, as recited in claim 1, wherein in the step e), when adding the purifying ball, a tube is at an opposite side of a feeding opening.

* * * * *